United States Patent [19]

Eckhardt et al.

[11] Patent Number: 4,970,440

[45] Date of Patent: Nov. 13, 1990

[54] ORIENTATION INDEPENDENT IGNITRON WITH GROOVED CATHODE

[75] Inventors: Wilfried O. Eckhardt; Hayden E. Gallagher, both of Malibu; Roland G. Fleig, Oxnard, all of Calif.

[73] Assignee: Hughes Aircraft Company, Los Angeles, Calif.

[21] Appl. No.: 256,673

[22] Filed: Oct. 12, 1988

[51] Int. Cl.[5] ..... H01J 17/08

[52] U.S. Cl. ..... 315/327; 315/112; 315/330; 315/335; 313/29

[58] Field of Search ..... 313/29; 315/112, 330, 315/327, 335

[56] References Cited

U.S. PATENT DOCUMENTS

| | | | |
|---|---|---|---|
| 1,847,646 | 3/1932 | Gaudenzi | 313/29 |
| 2,907,905 | 10/1959 | Humphrey | 313/32 |
| 3,475,636 | 10/1969 | Eckhardt | 313/29 |
| 3,659,132 | 4/1972 | Eckhardt | 313/32 |
| 4,093,888 | 6/1978 | Eckhardt et al. | 313/163 |
| 4,264,839 | 4/1981 | Bayless | 313/29 |

FOREIGN PATENT DOCUMENTS

| | | |
|---|---|---|
| 694539 | 7/1953 | United Kingdom . |
| 1191394 | 5/1970 | United Kingdom . |

OTHER PUBLICATIONS

H. E. Gallagher et al., "Repetition Rate Extension of the Orientation Independent Ignitron", Digest of Technical Papers, 4th IEEE Pulsed Conference, Jun. 1983.

*Primary Examiner*—Eugene R. LaRoche
*Assistant Examiner*—Do Hyun Yoo
*Attorney, Agent, or Firm*—V. D. Duraiswamy; P. M. Coble; W. K. Denson-Low

[57] ABSTRACT

An orientation independent ignitron (OII) has an anode, a cathode with a plurality of spaced grooves facing the anode, and a cooling mechanism which causes liquid metal vapor to condense as a film which is retained on the grooved cathode surface by surface tension and forms reservoirs within the grooves. The cathode and anode are preferably cylindrical and coaxial, with the inner surface of the cathode having parallel annular grooves facing the outer anode surface. Igniters are preferably introduced into convex areas between adjacent grooves along radial lines, with individual igniters providing ignition for a pair of adjacent grooves. The igniters can be operated simultaneously or in sequence, depending upon the desired repetition rate and current capacity. A liquid metal film is initially formed by placing the OII on its side, introducing liquid metal into the lower ends of the grooves, and causing arcing between the anode and liquid metal to flow the liquid metal and wet the adjacent groove surface. Some of the liquid metal also evaporates and re-condenses on other portions of the cathode, establishing a continuous film.

19 Claims, 3 Drawing Sheets

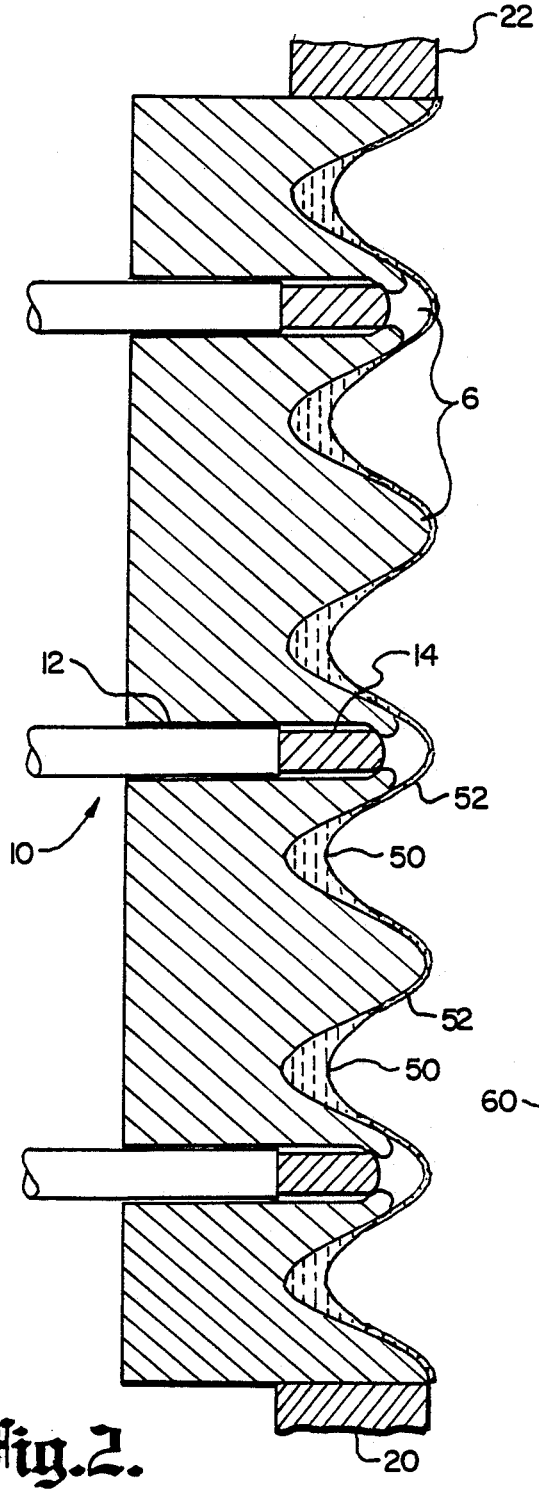
Fig.2.
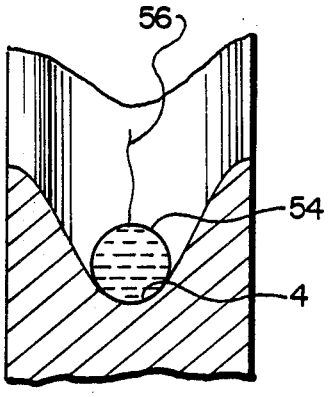
Fig.4.a.
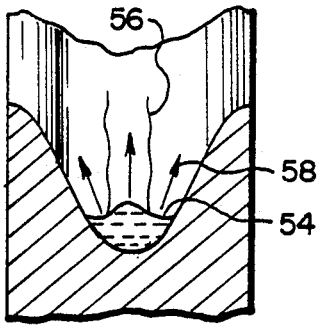
Fig.4.b.
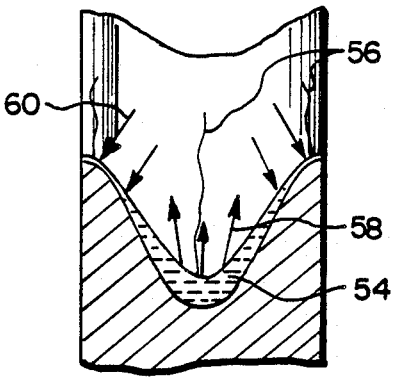
Fig.4.c.

ORIENTATION INDEPENDENT IGNITRON WITH GROOVED CATHODE

BACKGROUND OF THE INVENTION

Government Rights in Invention

This invention was made with U.S. Government support under Contract No. DNA 001-87-C-0089 awarded by the Defense Nuclear Agency. The U.S. Government has certain rights in this invention.

FIELD OF THE INVENTION

This invention relates to orientation independent ignitrons in which a liquid metal is retained as a film on a cathode surface, and conduction is initiated by igniting an arc between the liquid metal and an anode.

DESCRIPTION OF THE RELATED ART

An orientation independent ignitron (OII) has been developed in which a film of liquid metal is condensed upon a cooled cathode and held in place by surface tension, so that it is independent of orientation. The device is switched into conduction by an igniter that initiates arcing between the liquid metal film and an anode. The cathode is cooled during and after each conductive pulse so that the liquid metal recondenses on its surface and is available for another pulse. This type of device is disclosed in U.S. Pat. No. 4,264,839, issued Apr. 28, 1981 in the name of John R. Bayless, and assigned to Hughes Aircraft Company, the assignee of the present invention.

The OII was developed to provide a closing switch for use with high power pulse systems. It takes advantage of the simple design, high current carrying capability and low forward voltage drop of prior ignitrons, while eliminating the disadvantages of a liquid metal pool which prevented the prior ignitrons from being employed for variable orientation uses, such as mobile and space applications.

While the OII described in the Bayless patent has been successfully demonstrated, its current rating has been limited to 15 kA. Operating characteristics as well as the structure of this OII are described in articles by Harvey and Bayless, "Orientation Independent Ignitron", Digest of Technical Papers, 2nd International Pulsed Power Conference, June, 1979, and H. E. Gallagher and R. J. Harvey, "Repetition Rate Extension of the Orientation Independent Ignitron", Digest of Technical Papers, 4th IEEE Pulsed Conference, June, 1983. It would be desirable to have a device with a significantly higher current rating, thus permitting greater power transfers.

Prior to the development of the OII, a liquid metal plasma valve (LMPV) was implemented. Various LMPV designs are described in U.S. Pat. Nos. 3,475,636 and 3,659,132 by the present applicant, and U.S. Pat. No. 4,093,888 by the present applicant and G. Eckhardt, all assigned to Hughes Aircraft Company. The LMPV has a relatively long turn-on time due to its low operating pressure, and also requires a positive liquid metal feed system. It is normally operated to conduct considerably longer current pulses than an OII.

The various LMPV designs combine the properties of classical liquid metal arc devices, such as ignitrons and multi-gap, multi-anode mercury valves, with those of classical solid cathode vacuum-arc devices such as triggered vacuum gaps and vacuum interrupters. The cathode of the LMPV must be force fed with liquid metal, in proportion to the demand current. Depending upon the particular configuration, LMPVs may be used as rectifier and inverter valves, for high voltage closing switch service, and for inductive energy storage circuits. However, the LMPV construction is more complicated than that of the existing OII because of the requirement for a liquid metal feed in proportion to the current demand.

SUMMARY OF THE INVENTION

In view of the above problems, the present invention seeks to provide an OII with a significantly greater current rating than prior OIIs, and without the complication of an LMPV.

An improved OII of this type is achieved by providing the OII cathode with a plurality of spaced grooves which carry most of the liquid metal. The cathode is preferably a generally cylindrical hollow body, with annular and parallel multiple grooves on the inner cathode surface. The anode is preferably a generally cylindrical body which is disposed coaxially inward from the cathode.

A plurality of igniters are provided to generate a plasma from the liquid metal on the cathode surface so as to initiate conduction between the cathode and anode. In one embodiment, the igniters extend through the cathode to locations at approximately the apices of concave sections separating successive grooves, with the igniters disposed generally normal to the outer cathode surface. In this embodiment, the number of igniters can be less than the number of cathode grooves, with at least some of the igniters positioned between adjacent grooves so as to initiate arcing between both of those grooves and the anode. The igniters may also be pulsed in a non-simultaneous sequence to provide each individual igniter with additional time for cooling between pulses.

The invention also includes a method of initially wetting the inner cathode surface with a liquid metal film, so that it can thereafter function independent of any particular orientation. This method consists of positioning the OII so that the cathode is on its side, with its grooves generally vertical. Liquid metal reservoirs are accumulated at the lower ends of the grooves, and arcing is initiated between the anode and the accumulated liquid metal. The arcing is sustained with a sufficient current density and for a sufficient period of time so that the liquid metal reservoirs flow and wet the adjacent surface of the cathode. At the same time, the arcing causes the liquid metal to evaporate from the reservoirs and condense on the remainder of the cathode surface, so that the arcing progresses onto all the areas of the cathode surface where liquid metal has condensed. This causes the condensed liquid metal to wet against these new areas of the cathode surface and eventually form a continuous liquid metal film which is retained on the cathode by surface tension.

The improved OII has been found to have a current rating greater than six times that of the previous OII design, and the conductive charge per pulse has been increased by approximately three orders of magnitude. These and other features and advantages of the invention will be apparent to those skilled in the art from the following detailed description of preferred embodiments, taken together with the accompanying drawings, in which:

DESCRIPTION OF THE DRAWINGS

FIG. 2 is a fragmentary sectional view of the grooved cathode wall;

FIGS. 4*a*, 4*b* and 4*c* illustrate successive steps in a process for initially forming a liquid metal film over the cathode surface.

DETAILED DESCRIPTION OF THE INVENTION

Figure 1:
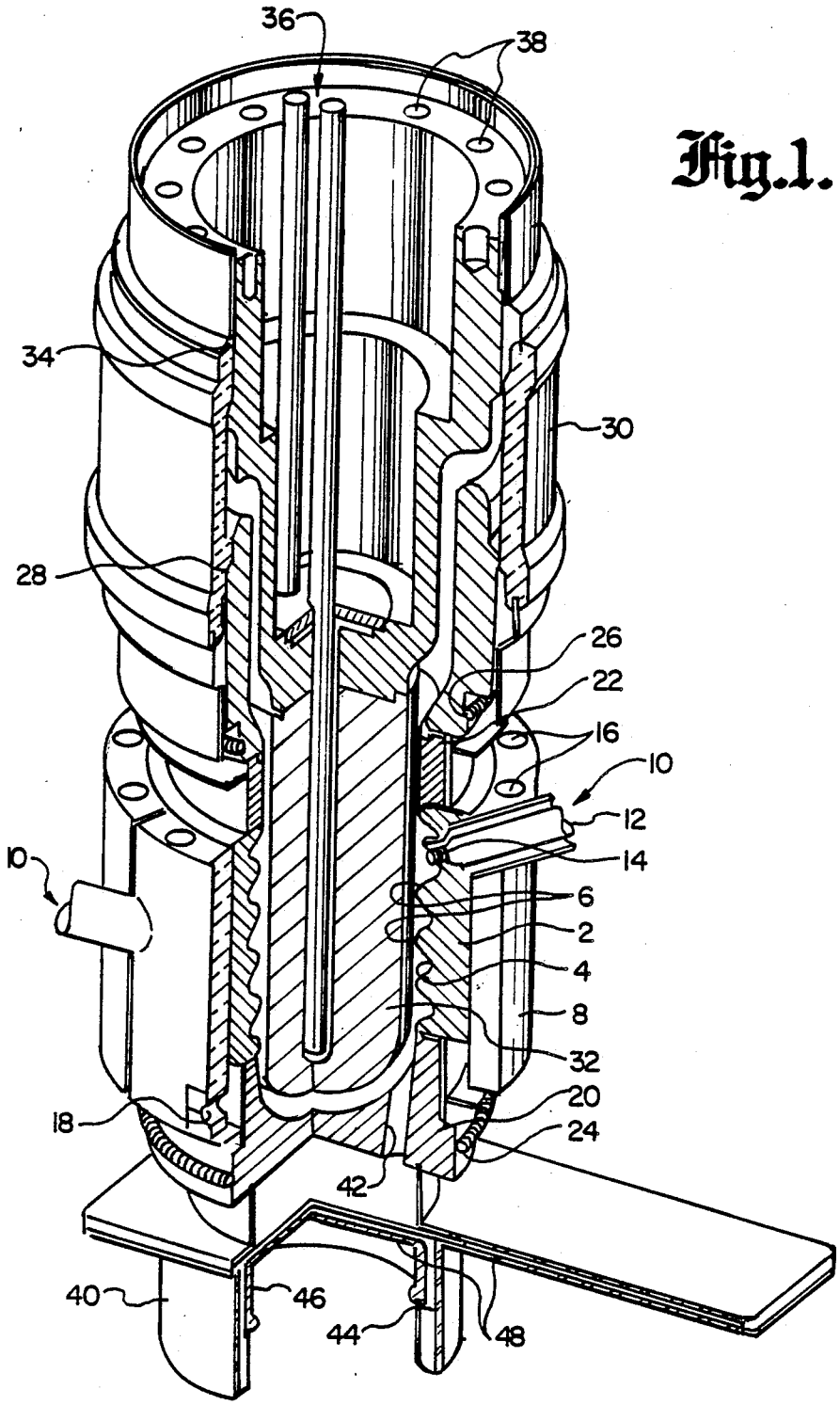
FIG. 1 is a cut-away view in perspective showing the OII of the present invention.

A preferred form of the invention is shown in FIG. 1. A generally cylindrical cathode 2, preferably of molybdenum, has an inner surface with a series of spaced, parallel annular grooves 4 extending into the surface. The grooves are separated by annular convex sections 6. The cathode is surrounded by a cooling jacket 8, which is liquid cooled to maintain the cathode at a temperature of about 0°–10° centigrade. At this temperature liquid mercury will condense on the inner cathode surface.

A number of igniters 10 extend inwardly through the cathode cooling jacket 8 and cathode 2 to initiate arcing within the OII. One igniter may be provided per groove or, as described below, less than one igniter per groove may be furnished if the igniters are positioned to ignite arcing to more than one groove. The igniters 10 consist of an igniter rod 12 which carries an igniter tip 14 at its inner end. Igniter tip 14 is preferably of boron carbide or other arc-resistant semiconducting material. The igniters are connected to a source of ignition current to cause an ignition arc. The igniters 10 are held in place by respective igniter tubes 16, which protrude through corresponding openings in the cathode and cathode cooling jacket.

Electrical connection is made to the cathode via leads connected to tapped holes 18 in the cooling jacket 8. In the illustrated embodiment of FIG. 1, six cathode leads are brought in around the circumference of the cathode cooling jacket.

Generally cylindrical cathode delimiters 20 and 22, also preferably formed from molybdenum, are placed at the lower and upper ends of the cathode 2. Heating coils 24 and 26 heat the delimiters so that mercury vapor within the interior of the OII cannot condense on the delimiter surface, thereby restricting condensation to the cathode. A cathode insulator shield 28, preferably molybdenum or copper, helps to electrically shield the inside of the insulator and thereby prevent breakdown. The cathode and anode are connected by an insulating ring 30 of glass or ceramic material.

A generally cylindrical anode 32, also formed from molybdenum, is located radially inward of the cathode 2, with the outer anode surface facing the inner cathode surface and grooves across an arc gap. The anode 32 is supported from above by a molybdenum or copper anode insulator shield 34. Input and output anode cooling lines 36 circulate a coolant through the anode to keep its outer surface within a temperature range of about 90°–120° C., which is cool enough to prevent malfunction but hot enough to prevent mercury condensation on the anode surface. For this purpose, hot liquid cooling is utilized. Electrical connection is made to the anode via leads attached to a series of tapped holes 38 at the upper end of the conductive anode insulator shield 34.

The OII is sealed so that the device may be operated at low pressure. A vacuum pump (not shown) communicates with the interior of the OII via a stainless steel cylinder 40 at the lower end. A path for the evacuation of gas from the interior of the OII, and also for the introduction of mercury vapor into the OII, includes a series of ports 42 extending upwardly through the floor of the lower cathode delimiter 20, and an annular gap 44 between the cylinder 40 and an inner glass cup 46. For experimental purposes, a transparent window and shutter assembly 48 is provided to seal the bottom of the OII, while giving visual access to the interior of the device through the transparent window and ports 42.

A more detailed view of a grooved cathode surface is given in FIG. 2. When a liquid metal such as mercury is condensed as a film on the cathode surface, reservoirs 50 of the liquid metal are formed in the innermost portions of the grooves, while a thin film 52 of the liquid metal is formed over the remainder of the inner cathode surface. The liquid metal is held in place and prevented from running off by the surface tension of the film. In contrast to prior OIIs in which the igniter was brought in generally normal to the arcing path between the cathode and anode, in the preferred embodiment of the invention the igniters are generally normal to the outer cylindrical surface of the cathode, and thus generally parallel to the arcing paths. This positioning of the igniters on a radius of the cylindrical cathode makes for a more secure placement, with minimum size igniter openings in the outer cathode wall.

While the igniter tips 14 could be positioned adjacent the liquid metal reservoirs 50, they preferably terminate near the apices of the convex cathode sections 6, equally spaced between the two adjacent grooves. With this arrangement, arcing between the cathode and anode is initiated at or near these apices, and travels down the liquid metal film as it evaporates until the arcing reaches the edge of reservoir 50. As arcing continues during the pulse, liquid metal atoms are gradually evaporated from the reservoir, causing its surface to recede. This has an advantageous effect, since it increases the positive slope of the current-voltage characteristics of individual cathode arc spots by making the local electron-to-atom emission ratio at each spot a function of the local liquid metal level. This ratio increases as the local liquid metal level recedes towards the bottom of a groove, since the atom evaporation rate from the liquid metal surface is reduced as that surface area shrinks. The result is a stabilization of current sharing among arc spots, and stabilization of current sharing when several OIIs are operated in parallel.

The purpose of the ignitron is to turn on in the presence of an applied forward voltage, and to conduct a large current after turn-on. When forward voltage is applied, turn-on is accomplished by pulsing a current through igniter tip 14. This causes a discharge between the liquid metal on the cathode surface and the igniter tip, vaporizing and ionizing a portion of the liquid metal film. This plasma material permits initiation of conduction between the cathode and anode.

Another advantage of the illustrated configuration is that the overall electron-to-atom emission ratio is kept at a high level. Once the arcing has reached the edges of the liquid metal reservoirs 50, it has been found to stabilize in the "beach" area of the edges, rather than continue on towards the centers of the reservoirs. This is an advantage, since arcing at the centers of the reservoirs tends to heat up the liquid metal, which in turn increases the atomic emission rate. If the emission rate is excessive, it can be difficult to hold off arcing as the voltage increases at the beginning of the next switching cycle until the desired voltage is reached. Accordingly, it is desirable that the liquid metal atomic emission rate be limited. This is accomplished by restricting the arcing to the edges of the liquid metal reservoirs, where the generated heat is mostly absorbed by the cooled cathode and much less is available to vaporize the liquid metal. Whereas electron/atomic emission rates on the order of about 8 are encountered at the centers of the reservoirs, this rate increases to the order of about 200 at the edges of the reservoirs.

Molybdenum is the preferred material for both the anode and cathode to reduce both the chance of spot formations on the anode, and the contamination of the cathode that results if an anode spot does occur. In a particular implementation, a maximum permissible anode temperature increase of 900° C. was selected for a maximum equivalent square pulse duration of 10 ms. This choice of parameters, together with an assumed energy density input of 30 watts/ amps.cm$^2$, resulted in a permissible anode current density of 500 A/cm$^2$. For a square pulse current of 50 kA, the above anode current density resulted in a required anode area of 100 cm$^2$.

An anode-cathode gap spacing of 0.5 cm was selected to have a sufficiently large gap to accommodate an anticipated voltage hold-off requirement of 25 kV at low mercury vapor pressure, while at the same time maintaining a sufficiently small gap to avoid Paschen breakdown at high mercury vapor pressure. This anode-cathode gap spacing resulted in a cathode diameter at the edges of the mercury reservoirs of 6.4 cm. The anode diameter was 5 cm.

For five parallel cathode grooves, with an anode length of 6.4 cm, the five grooves resulted in a total mercury reservoir edge perimeter (2 edges per groove) of 200 cm. The distribution of 50 kA along the total cathode reservoir edge area resulted in a linear current density of 250 A/cm, which is one-third of the 750 A/cm limit that has been determined for stable steady-state anchoring of the cathode arc spots at the edges of the liquid mercury reservoirs.

Only a relatively shallow groove is necessary to hold sufficient liquid mercury. However, forming the grooves with a side-wall angle of about 60° was found to optimize the stability of the arc spot anchoring at the edges of the reservoirs. Also, grooves deeper than the minimum necessary to hold sufficient mercury are better able to accommodate the igniters.

Referring again to FIG. 2, only one igniter need be provided for every two grooves. The igniters are positioned at the apices of the convex sections between adjacent grooves, and ignite arcing on both sides of the convex section. The arcing travels down to the edges of the two adjacent reservoirs. This reduces the number of required igniters by half compared to the provision of a separate igniter for each groove, without impairing the operation of the device.

The particular dimensions and operating parameters described above are illustrative only, and should not be taken as limiting. With the described OII, pulse currents of 50–100 kA have been achieved with a hold-off voltage of 15 kV and an on-switching power of 1.5 GW, with 20 ms exponentially decaying pulses. The maximum conducted charge per pulse was 320 Coulombs. The nominal repetition rate was 1 pulse every 20 seconds, with a 3 pulse maximum repetition rate of 1 per second.

Figure 3:
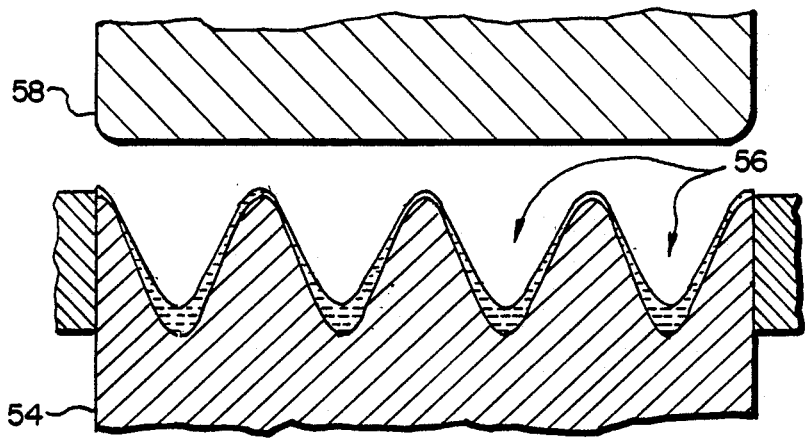
FIG. 3 is a fragmentary sectional view showing another embodiment of the invention in which the cathode is generally a disk containing coaxial grooves, parallel to a flat anode.

Various configurations of a grooved OII cathode other than the vertical coaxial arrangement discussed above are possible. One example is illustrated in FIG. 3, in which the upper surface of a cathode 54 is provided with a series of ring-shaped grooves 56. An anode 58 is positioned over the cathode, with a lower anode surface facing the grooved cathode surface. In this design, however, there is a tendency for the arcing current to deflect off to one side of the cathode, since this has the effect of increasing the overall inductance of the system. In the arrangement shown in FIG. 1, by contrast, the inductance does not change when the arcing current moves, so there is no tendency for the current to deflect away from an evenly balanced distribution.

The invention also encompasses a novel technique for initially forming a liquid metal film on the cathode surface. A well-wetted cathode surface is necessary to achieve reliable anchoring of the arcs during pulse operation at up to the highest design currents. With the LMPV, wetting of the cathode was achieved by deliberately underfeeding the supply of liquid metal so that only a very small amount of liquid metal was present at the throat of the groove. Arcing was then initiated between the anode and the liquid metal, causing the edges of the liquid metal to wet against the adjacent cathode material. More liquid metal was gradually fed in, causing the liquid metal level to gradually rise and wet progressively larger portions of the cathode surface as arcing continued.

With the described OII, by contrast, the amount of mercury within the system is fixed, and is not increased or diminished by external control once the system is sealed. The novel method of forming a liquid metal film is illustrated in FIGS. 4*a*, 4*b* and 4*c*. These figures show a single cathode groove, but equivalent action occurs in the other grooves.

Initially, the OII is turned on its side so that the grooves are generally vertical, and mercury vapor is introduced into the interior of the device. The mercury settles onto the cooled surface at the lower end of each groove 4, forming a bead or reservoir 54 at the bottom of each groove 4. Appropriate voltages are applied to the anode, cathode and igniters to initiate arcing, indicated by wavy line 56, between the reservoir 54 of liquid mercury and the anode (not shown). Since no film has yet been formed, the arc is not anchored to the edges of the reservoir, and instead is most dense towards the center of the mercury reservoir. The arcing heats the liquid mercury, causing it to progressively flow and wet the sides of the groove. An intermediate stage in the process is illustrated in FIG. 4*b*, with the liquid mercury having wetted a portion of the adjacent groove walls.

Heating of the mercury also causes some of it to evaporate, as indicated by arrows 58, and to condense onto other portions of the cathode surface. Arcing then extends to these new areas where condensation has occurred, causing the mercury in these areas to also wet against the cathode surface. Towards the final stage of the conditioning process, illustrated in FIG. 4*c*, wetting of the adjacent groove walls from reservoir 54 has further progressed, while the deposition of mercury vapor by condensation on the other portions of the cathode surface (indicated by arrows 60) has resulted in a continuous mercury film over substantially the entire inner cathode surface. At this point, with the cathode surface fully wetted, the ignitron is orientation independent. It can be moved to other positions, the mercury film and reservoirs 54 remaining in place by surface tension. While the total current utilized in this wetting process can be equal or less to the operating OII current, the current is restricted to a much smaller area and therefore results in a considerably higher current density.

Figure 5:
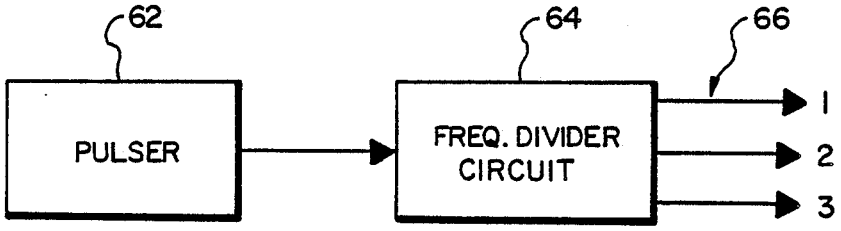
FIG. 5 is a block diagram illustrating a circuit for operating the OII igniters in sequence, rather than simultaneously.

One of the limitations of available igniters is that it can be difficult to stay within the igniter temperature limit for high pulse repetition rates. This problem can be alleviated for a multiple-igniter OII of the type described herein by pulsing the igniter sequentially at a predetermined rate, rather than simultaneously. A simplified circuit for accomplishing this is shown in FIG. 5. It consists of a pulser circuit 62 which feeds pulses at the desired repetition rate to a frequency divider circuit 64. The latter circuit actuates its output lines 66 in sequence, which in turn supply the respective igniters. To ensure that a shorting of an igniter (such as by liquid metal condensation or overheating) does not pull down the driving voltage of other igniters, the igniters may be decoupled by using segregated pulse amplifiers, one for each igniter.

While the pulsing of only one igniter at a time may slightly increase ignition jitter, it permits the pulse repetition rate to be increased by a factor equal to the total number of individual igniters (for a fixed conducted charge per pulse burst). Each igniter has additional time for cooling between pulses, as compared to a simultaneous firing of all the igniters at the same rate.

While different embodiments of an improved OII have thus been shown and described, numerous variations and alternate embodiments will occur to those skilled in the art. For example, the cathode could be surrounded by the anode. Accordingly, it is intended that the invention may be practised otherwise than as specifically described in the specification within the spirit and scope of the present invention as defined in the appended claims.

We claim:

1. An orientation independent ignitron, comprising:

a cathode having a surface with a plurality of spaced grooves, an anode having a surface spaced from and facing said grooved cathode surface, said grooved cathode surface being generally annular, said anode and cathode being coaxial with respect to each other, means for cooling said cathode sufficiently so that liquid metal vapor between said cathode and anode condenses as a film retained on said grooved cathode surface by surface tension and forms reservoirs within said grooves, and means for applying a voltage differentially between said cathode and anode sufficient to sustain a metal vapor arc between said anode and the liquid metal coated for a pulse period.

2. The orientation independent ignitron of claim 1, wherein said anode has a generally cylindrical surface facing said cathode, and said cathode surrounds said anode.

3. The orientation independent ignitron of claim 2, said cathode grooves being generally parallel and annular.

4. The orientation independent ignitron of claim 1, further comprising a plurality of igniters adjacent at least some of said cathode grooves for generating a plasma from the liquid metal on said cathode surface to initiate conduction between said cathode and anode.

5. The orientation independent ignitron of claim 4, said grooved cathode surface being characterized by generally convex sections bounding successive grooves, wherein said igniters extend through the cathode to locations at approximately the apices of respective convex sections.

6. The orientation independent ignitron of claim 5, said cathode having an outer surface which is generally parallel to its grooved surface, wherein said igniters extend through the cathode generally normal to said outer surface.

7. The orientation independent ignitron of claim 5, wherein fewer igniters than cathode grooves are provided, and at least one of said igniters is positioned between adjacent grooves so as to initiate arcing between both of said adjacent grooves and the anode.

8. The orientation independent ignitron of claim 4, further comprising a pulsing circuit for said igniters, said circuit firing said igniters in a non-simultaneous sequence at a predetermined rate, thereby providing each igniter with additional time for cooling between firings compared to a simultaneous pulsing of the igniters at said predetermined rate.

9. An orientation independent ignitron, comprising:

a generally annular cathode having a plurality of spaced annular grooves having concave sections on its inner surface;

an anode coaxially disposed within said cathode and having an anode surface spaced from and facing said inner cathode surface, means for cooling said cathode sufficiently so that liquid metal vapor between said cathode and anode condenses as a film retained on said cathode inner surface by surface tension and forms generally annular reservoirs within the concave sections of said grooves, and means for applying a voltage differential between said cathode and anode sufficient to sustain a metal vapor arc between said anode and the liquid metal coated cathode for a pulse period.

10. The orientation independent ignitron of claim 9, further comprising a plurality of igniters adjacent at least some of said cathode grooves for generating a plasma from the liquid metal on said cathode surface to initiate conduction between said cathode and anode.

11. An orientation independent ignitron, comprising:

a generally annular cathode having a plurality of spaced annular grooves on its inner surface, said inner cathode surface being characterized by generally convex section bounding successive grooves, an anode disposed within said cathode and having an anode surface spaced from and facing said inner cathode surface, means for cooling said cathode sufficiently so that liquid metal vapor between said cathode and anode condenses as a film retained on said cathode inner surface by surface tension and forms generally annular reservoirs within said grooves, means for applying a voltage differential between said cathode and anode sufficient to sustain a metal vapor arc between said anode and the liquid metal coated cathode for a pulse period, and a plurality of igniters adjacent at least some of said cathode grooves for generating a plasma from the liquid metal on said cathode surface to initiate conduction between said cathode and anode, wherein said igniters extend inwardly through the cathode to locations at approximately the apices of respective convex sections.

12. The orientation independent ignitron of claim 11, wherein the outer cathode surface is generally cylindrical, and said igniters extend generally radially inward therefrom.

13. The orientation independent ignitron of claim 11, wherein fewer igniters than cathode grooves are provided, and at least one of said igniters is positioned between adjacent grooves so as to initiate arcing between both adjacent grooves and the anode.

14. The orientation independent ignitron of claim 11, further comprising a pulsing circuit for said igniters, said circuit firing said igniters in a non-simultaneous sequence at a predetermined rate, thereby providing each igniter with additional time for cooling between firings compared to a simultaneous pulsing of the igniters at said predetermined rate.

15. A method of wetting the inner surface of a generally cylindrical orientation independent ignitron cathode with a liquid metal film, said inner cathode surface having a plurality of generally annular grooves facing and spaced from an anode which is interior to the cathode, comprising:

positioning said cathode on its side with said grooves generally vertical, accumulating liquid metal reservoirs at the lower ends of said grooves, establishing metal vapor arcing between said anode and the liquid metal within said grooves, sustaining said arcing with a sufficient current density and for a sufficient period of time so that said liquid metal reservoirs flow and wet the adjacent surface of said grooved cathode, liquid metal evaporates from said reservoirs and condenses on the remainder of the grooved cathode surface, and said arcing progresses to the areas of the cathode surface upon which liquid metal has condensed to wet the condensed liquid metal against the cathode surface and form a liquid metal film retained on substantially the entire grooved cathode surface by surface tension.

16. An orientation independent ignitron, comprising:

a cathode having a surface with a plurality of spaced grooves, said grooved cathode surface being characterized by generally convex sections bounding successive grooves, an anode having surface spaced from and facing said cathode surface, means for cooling said cathode sufficiently so that liquid metal vapor between said cathode and anode condenses as a film retained on said cathode grooved surface by surface tension and forms reservoirs within said grooves, means for applying a voltage differential between said cathode and anode sufficient to sustain a metal vapor arc between said anode and the liquid metal coated cathode for a pulse period, and a plurality of igniters adjacent at least some of said cathode grooves for generating a plasma from the liquid metal on said cathode surface to initiate conduction between said cathode and anode, said igniters extending through the cathode to locations at approximately the apices of respective convex sections.

17. The orientation ignitron of claim 16, said cathode having an outer surface which in generally to its grooved surface, wherein said igniters extend through the cathode generally normal to said outer surface.

18. The orientation independent ignitron of claim 16, wherein fewer igniters than cathode grooves are provided, and at least one of said igniters is positioned between adjacent grooves so as to initiate arcing between both of said adjacent grooves and the anode.

19. The orientation independent ignitron of claim 16, further comprising a pulsing circuit for said igniters, said circuit firing said igniters in a non-simultaneous sequence at a predetermined rate, thereby providing each igniter with additional time for cooling between firings compared to a simultaneous pulsing of the igniters at said predetermined rate.

* * * * *

UNITED STATES PATENT AND TRADEMARK OFFICE

CERTIFICATE OF CORRECTION

PATENT NO. : 4,970,440

DATED : November 13, 1990

INVENTOR(S) : WILFRIED O. ECKHARDT, et al.

It is certified that error appears in the above-identified patent and that said Letters Patent is hereby corrected as shown below:

Col. 10, line 31, delete "in" and insert --is--;

line 31, after the word "generally", insert --parallel--.

Signed and Sealed this

Nineteenth Day of October, 1993

Bruce Lehman

*Attest:*

BRUCE LEHMAN

*Attesting Officer*

*Commissioner of Patents and Trademarks*